US006910517B1

(12) United States Patent
Randall

(10) Patent No.: US 6,910,517 B1
(45) Date of Patent: Jun. 28, 2005

(54) EQUALIZING CONNECTOR FOR MULTI-CORD ARCHITECTURAL COVERING

(75) Inventor: Raymond E. Randall, New Hartford, NY (US)

(73) Assignee: Comfortex Corporation, Watervliet, NY (US)

( * ) Notice: Subject to any disclaimer, the term of this patent is extended or adjusted under 35 U.S.C. 154(b) by 35 days.

(21) Appl. No.: 10/680,634

(22) Filed: Oct. 7, 2003

Related U.S. Application Data

(60) Provisional application No. 60/416,728, filed on Oct. 7, 2002.

(51) Int. Cl.[7] ..... E06B 9/38
(52) U.S. Cl. ..... 160/178.1 R; 24/115 F
(58) Field of Search ..... 160/178.1 R, 178.2 R, 160/173 R, 168.1 R, 176.1 R; 24/115 F, 24/602; 16/442, 428

(56) References Cited

U.S. PATENT DOCUMENTS 5,542,461 A * 8/1996 Huang ..... 160/178.1 R
5,542,462 A * 8/1996 Elsenheimer et al. . 160/178.1 R
5,560,414 A * 10/1996 Judkins et al. ..... 160/178.1 R
5,715,884 A * 2/1998 Cotten ..... 24/115 A
5,908,063 A * 6/1999 Gobidas ..... 160/178.1 R
6,044,523 A * 4/2000 Ortega ..... 16/442
6,263,946 B1 * 7/2001 Cotten ..... 160/178.1 R
6,640,870 B2 * 11/2003 Osinga ..... 160/178.1 R

* cited by examiner

*Primary Examiner*—David Purol
(74) *Attorney, Agent, or Firm*—Rader, Fishman & Grauer PLLC

(57) ABSTRACT

A connector is provided for releasably connecting a manipulating cord to the lift cords of an architectural covering. In an embodiment of the invention, the connector includes a resiliently compressible inner assembly and an outer shell. The inner assembly is connected to the manipulating cord of the architectural covering. The outer shell includes at least two shell sections that are releasably mounted on the inner assembly. Each shell section is secured to an individual lift cord. Outward movement of the lift cords and/or compression of the inner assembly releases the outer shell from the inner assembly.

11 Claims, 5 Drawing Sheets

EQUALIZING CONNECTOR FOR MULTI-CORD ARCHITECTURAL COVERING

CROSS-REFERENCE TO RELATED APPLICATIONS

This application claims the benefit of U.S. provisional patent application No. 60/416,728 filed on Oct. 7, 2002, which is incorporated by reference herein in its entirety.

BACKGROUND OF THE INVENTION

1. Field of the Invention

The present invention generally relates to architectural coverings and treatments. More particularly, the present invention relates to releasable, breakaway safety devices for use with corded architectural coverings.

2. Description of the Related Art

Many types of architectural coverings and treatments such as Venetian-style blinds, cellular or pleated shades, and variants of these (herein represented without restriction merely by "architectural covering"), generally utilize one or more internal cords, commonly referred to as "lift cords." In an architectural covering, the lift cords are typically anchored to a lower rail and run upward through a shade or blind into an upper rail. Generally, more than one lift cord is required in relatively wide architectural coverings to provide uniform and level support of the lower rail.

The manipulable ends of these cords, which exit the upper rail through a cord-lock mechanism, are typically joined with a tassel and are used by an operator to pull on the cords for raising and lowering the lower rail and shade. Optionally, the portion of the lift cords exiting the upper rail may be joined together and affixed to a single extension cord and tassel using a connector. The connector is often referred to as an "equalizer" or "equalizing connector," because the lift cords may be knotted to the connector during manufacture, giving a manufacturer an opportunity to "equalize" the functional length of each cord (by knot placement or otherwise), to ensure all lift cords share the load of the lower rail and shade equally.

In recent years, cases have been documented in which a person, typically a baby or small child, perhaps in playing with such lift cords, becomes entangled in the exposed lift cords and is injured. When the lift cords are permanently interconnected by a cord equalizer or a cord tassel, the exposed lift cords can function as a noose that may choke or asphyxiate a child. For at least the foregoing reason, there is a need for an improved equalizing connector and architectural covering that overcomes the limitations of the prior art.

SUMMARY OF THE INVENTION

A connector is provided for releasably connecting a manipulating cord to the lift cords of an architectural covering. In an embodiment of the invention, the connector includes a resiliently compressible inner assembly and an outer shell. The inner assembly is connected to the manipulating cord of the architectural covering. The outer shell includes at least two shell sections that are releasably mounted on the inner assembly. Each shell section is secured to an individual lift cord. Outward movement of the lift cords and/or compression of the inner assembly releases the outer shell from the inner assembly.

BRIEF DESCRIPTION OF THE DRAWINGS

Embodiments of the invention will now be described, by way of example, with reference to the accompanying drawings, wherein.

DETAILED DESCRIPTION

Figure 1:
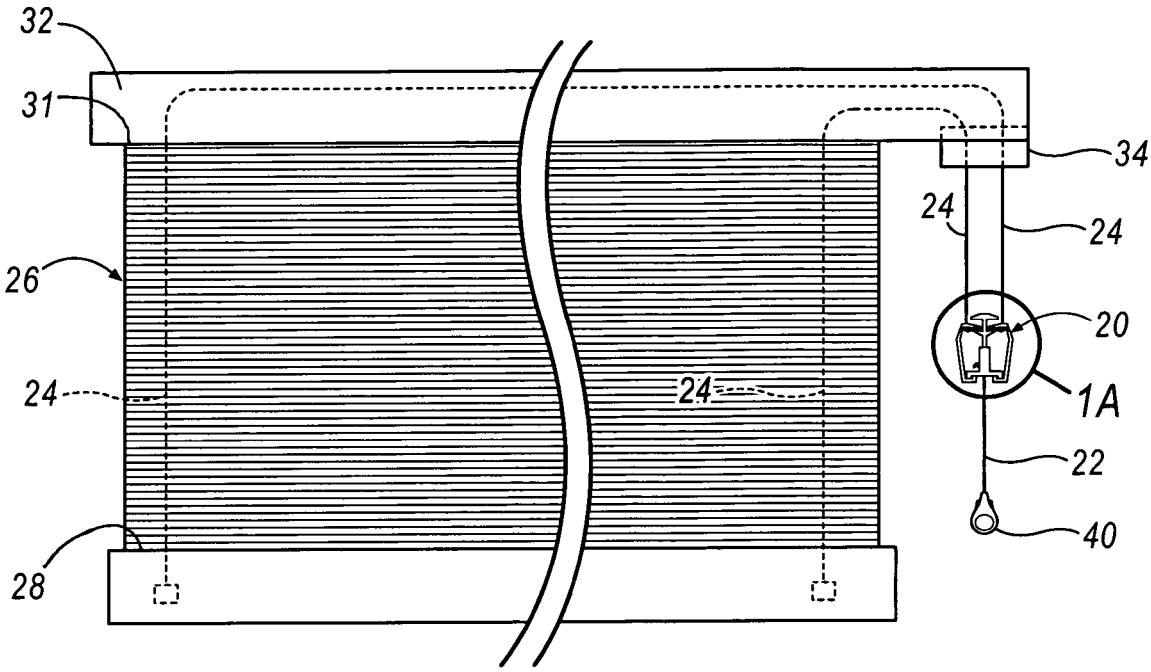
FIG. 1 is a front elevation view of an architectural covering that includes a connector according to an embodiment of the present invention.

Referring now to the drawings, the preferred illustrative embodiments of the present invention are shown in detail. Although the drawings represent some preferred embodiments of the present invention, the drawings are not necessarily to scale and certain features may be exaggerated to better illustrate and explain the present invention. Further, the embodiments set forth herein are not intended to be exhaustive or otherwise limit or restrict the invention to the precise forms and configurations shown in the drawings and disclosed in the following detailed description.

With reference to FIG. 1, an architectural covering 18 is shown that includes a connector 20 for attaching a manipulatable extension cord 22 to two or more lift cords 24 that facilitate raising and lowering of a shade 26. Shade 26 may comprise various types of adjustable and non-adjustable configurations, including without limitation, Venetian-style blinds, cellular or pleated shades, and variants thereof.

In an exemplary embodiment, shade 26 is secured along its lower edge 28 to a lower rail 30 and along its upper edge 31 to an upper rail 32 (sometime referred to as a "head rail"). Lift cords 24 are trained through a latch mechanism 34 in upper rail 32 and then over pulleys or guides (not shown) and downwardly through shade 26 to secured engagement with lower rail 30, as shown in FIG. 1. Latch mechanism 34 releasably engages cords 24 to hold shade 26 and lower rail 30 in a desired vertical position.

The term "cord," as used herein, should not be limited to the members shown in the drawings and may include various types of support members, including without limitation, tapes, ribbons, chains and the like, provided these members are flexible and capable of supporting the weight of lower rail 30 and shade portion 22. Also, the terms "lower" and "upper" are used herein to generally describe the illustrated relationship between rails 30 and 32, respectively. However, the features of the present invention may be employed in other architectural covering designs, such as those coverings employing side-to-side and other shade deployment configurations that do not necessarily include an "upper" or "lower" rail.

Figure 1A:
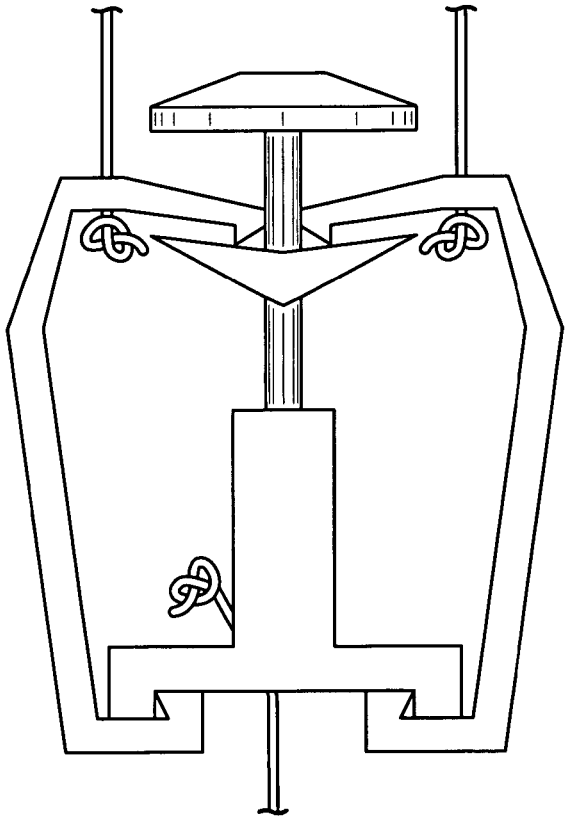
FIG. 1A is a detailed front elevation view of the connector shown in FIG. 1.
Figure 2:
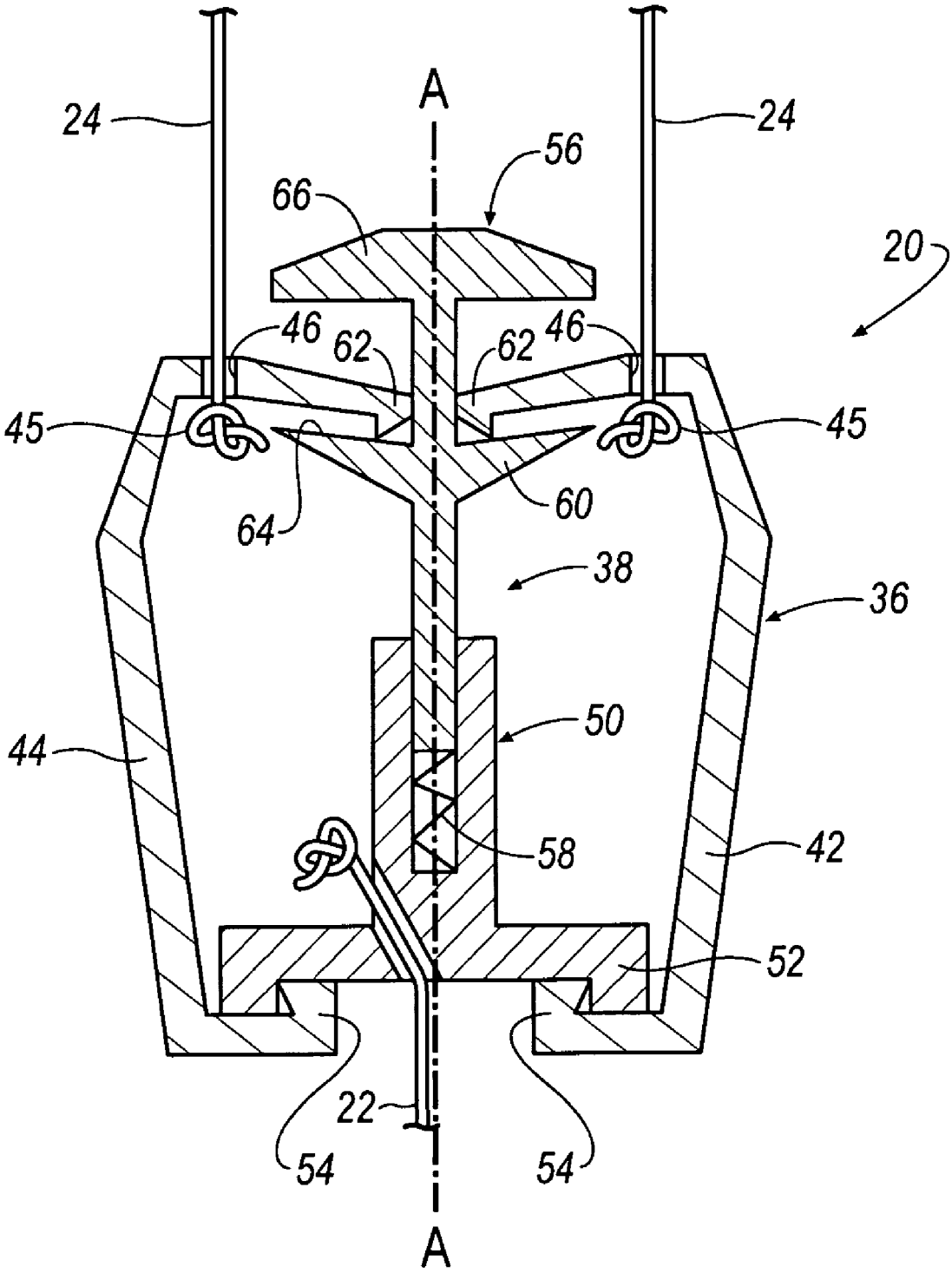
FIG. 2 is a cross-sectional view of the connector of FIG. 1 illustrating a pair of lift cords secured to the connector in an assembled state.

Referring to FIGS. 1A and 2, an embodiment of connector 20 is shown in detail. In the illustrated embodiment, connector 20 includes an outer shell 36 and a resiliently compressible inner assembly 38, which together exhibit a common vertical axis A—A. Outer shell 36 and inner assembly 38 are made from a rigid or semi-rigid material, such as plastic, metal and the like. Inner assembly 38 is anchored to the manipulable extension cord 22, which may include a tassel 40 (shown in FIG. 1) attached to a distal end thereof.

Figure 3A:
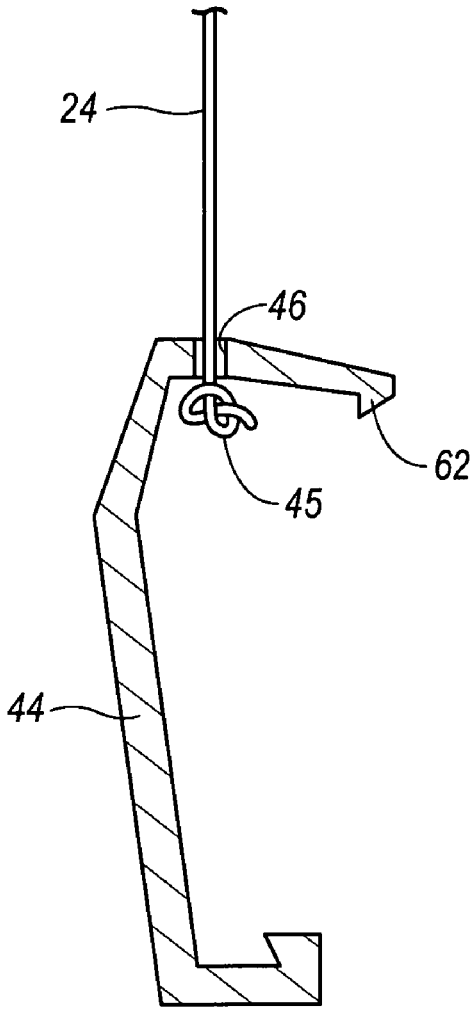
FIG. 3A is a cross-sectional view of an outer shell section embodiment for use in the connector of FIG. 1.
Figure 3B:
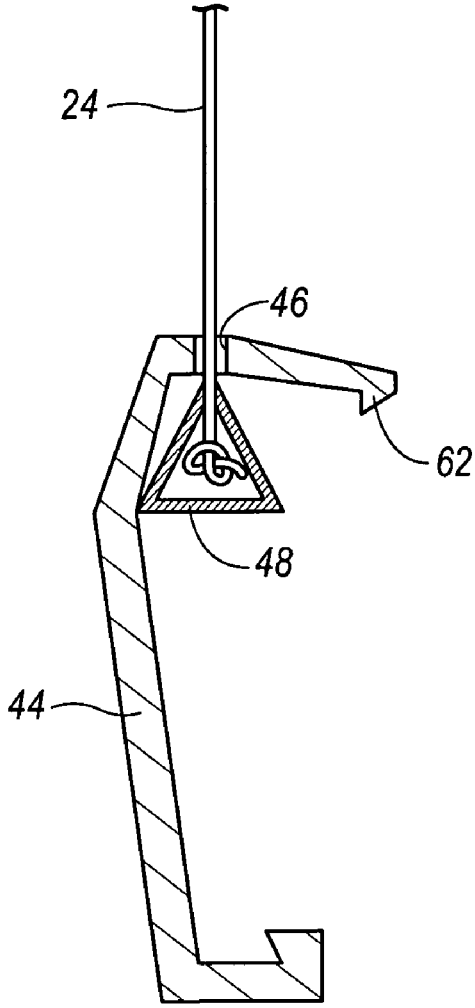
FIG. 3B is a cross-sectional view of another outer shell section embodiment for use in the connector of FIG. 1.

In a particular configuration, outer shell 36 includes a pair of shell sections 42, 44 that are each anchored to an individual lift cord 24. Lift cords 24 may be anchored to shell sections 42, 44 in any suitable manner, including without limitation, tying each lift cord 24 into a knot 45 that is larger than a through-hole 46, as shown in FIGS. 2 and 3A. Alternatively, lift cords 24 may be fixed to an anchoring member 48 that is larger than through-hole 46, as shown in FIG. 3B. It will be appreciated that shade 26 may be configured with any number of lift cords 24 and outer shell 36 with a corresponding number of shell sections.

In the embodiment illustrated in FIG. 2, inner assembly 38 includes a lower member 50 having a flange 52 that engages an upward facing tab 54 on a lower end of each shell section 42, 44. Inner assembly 38 also includes an upper member 56 that is biased by a resiliently compressible member 58, such as a compression spring, away from lower member 52. Upper member 56 includes an upwardly directed flange 60 that engages a radially inwardly directed upper edge 62 of each shell section 42, 44. A smooth upper surface 64 of flange 60 may be tapered radially inward to permit upper edge 62 of shell sections 42, 44 to slide across flange 60. As the spring force of resiliently compressible member 58 forces upper and lower members 56, 52 apart, shell sections 42, 44 are drawn radially inward toward axis A—A due to the declination of upper surface 64. Upper edge 62 of shell halves 42, 44 are also drawn toward axis A—A when a downwardly directed force is applied to extension cord 22.

Figure 4:
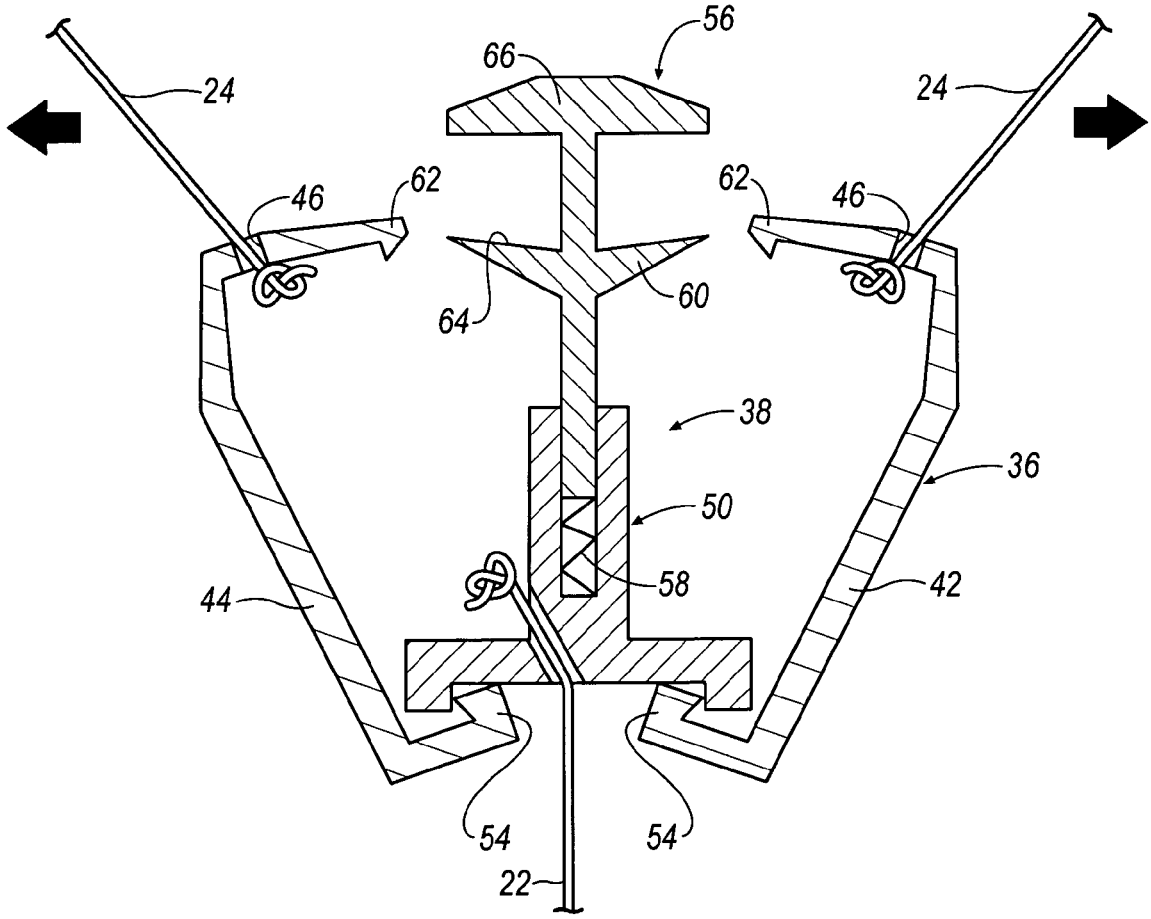
FIG. 4 is a cross-sectional view of the connector of FIG. 1 showing the connector in a partially disassembled state due to outward movement of the lift cords.

In contrast, an outwardly directed force applied to either of lift cords 24, or shell halves 42 and 44 directly, will cause upper edge 62 of shell halves 42, 44 to pivot away from inner assembly 38, as shown in FIG. 4. The smooth upper surface 64 of flange 60 permits shell halves 42, 44 to become disengaged from inner assembly 38 with only a minimal lateral force. Once the upper portion of each shell half 42, 44 is disengaged from inner assembly 38, there is little or no spring force acting to keep flange 52 and lower end 54 of each shell half 42, 44 engaged, and the components fall apart.

Figure 5:
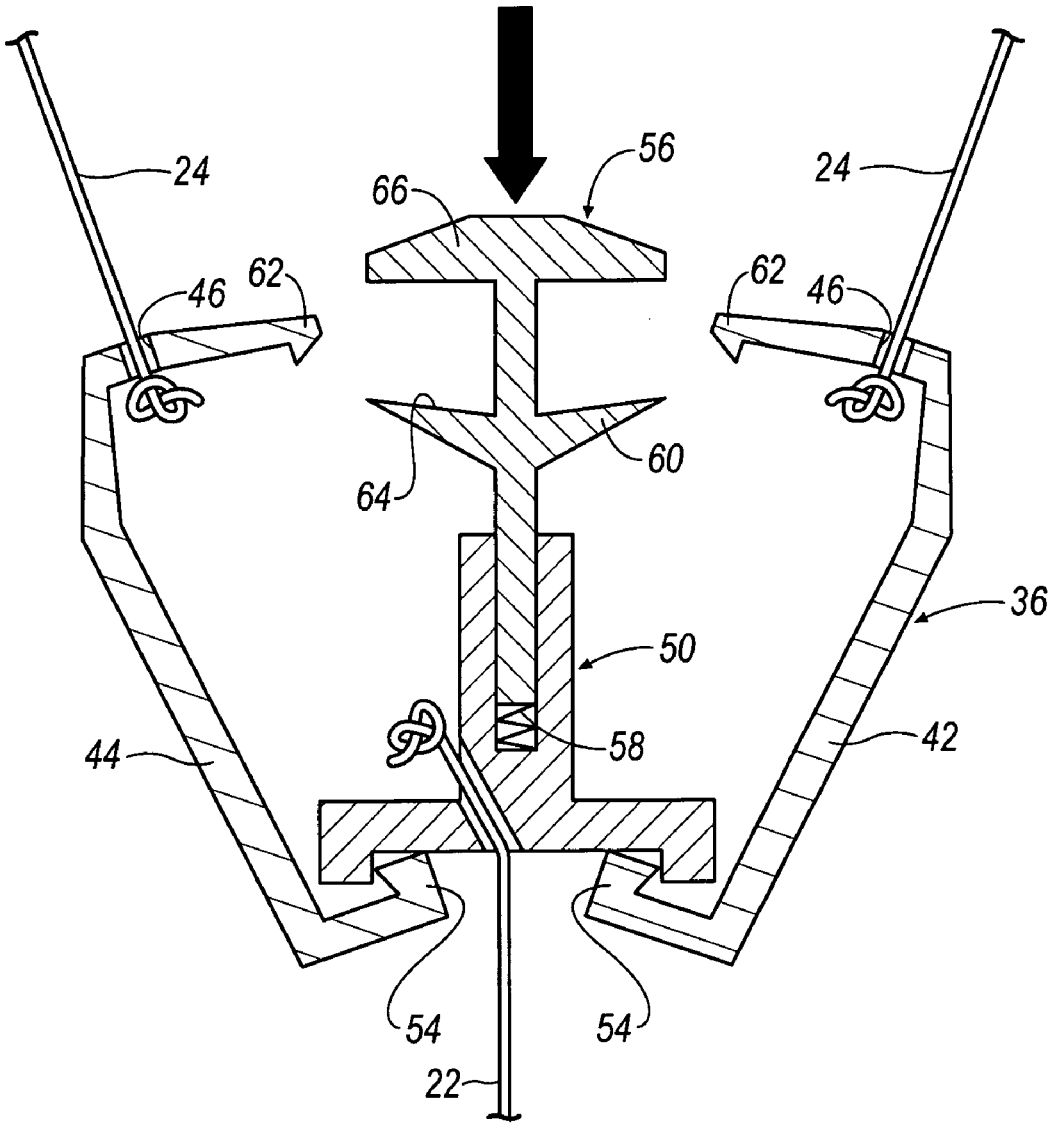
FIG. 5 is a cross-sectional view of the connector of FIG. 1 showing the connector in a partially disassembled state due to compression of an inner assembly of the connector.

Optionally, upper member 56 of inner assembly 38 may also include an extension 66 that extends upward from flange 60 beyond shell halves 42, 44. As illustrated in FIG. 5, downwardly directed pressure on extension 66 compresses resiliently compressible member 58, allowing shell halves 42, 44 to fall away from inner assembly 38. As will be appreciated, a child that becomes entangled in the exposed portion of lift cords 24 will cause outward movement of lift cords 24 (see, e.g., FIG. 4) and/or compression of the inner assembly 50 (see, e.g., FIG. 5), which releases outer shell 36 from inner assembly 50 and prevents injury.

Among other features, connector 20 is readily assembled and can be configured with any number of outer shell pieces to accommodate multiple lift cords. Connector 20 enables equalization of the exposed cord lengths, such as by knotting or attaching a separate anchoring member to the cords, for example. Connector 20 provides reliable, low force breakaway release of closed-loop lift cords in a multi-cord architectural covering, but does not tend to separate under the influence of normal operating forces.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. In an architectural covering having at least two lift cords and a connector for releasably connecting a manipulating cord to the lift cords, the connector comprising:

an inner assembly secured to the manipulating cord, said inner assembly including a lower member and an upper member that is moveable relative to the lower member, and further including a resiliently compressible member disposed between the upper member and the lower member; and an outer shell releasably mounted on the inner assembly, the outer shell including at least two shell sections, each shell section secured to a respective one of said lift cords.

2. The connector of claim 1, wherein the upper member includes a tapered flange.

3. The connector of claim 2, wherein an upper portion of each shell section rests on the tapered flange when the outer shell is mounted on the inner assembly.

4. The connector of claim 3, wherein the upper portion of each shell section is configured to slide on the tapered flange, whereby outward movement of the lift cords releases the outer shell from the inner assembly.

5. The connector of claim 3, wherein the lower member includes a flange that engages each shell section when the outer shell is mounted on the inner assembly.

6. The connector of claim 1, wherein the lift cords are attached to the outer shell by knotting the lift cords.

7. The connector of claim 1, wherein the lift cords are attached to an anchoring member that engages the outer shell.

8. The connector of claim 1, wherein compression of the inner assembly releases the outer shell from the inner assembly.

9. The connector of claim 1, wherein said manipulating cord is secured to said lower member.

10. The connector of claim 1, wherein said upper member includes an extension portion that projects upwardly out of said outer shell, downward pressure on said extension portion causing compression of said inner assembly and release of said outer shell from said inner assembly.

11. In an architectural covering having at least two lift cords and a connector for releasably connecting a manipulating cord to the lift cords, the connector comprising:

an outer shell including at least two shell sections, each shell section secured to a respective one of said lift cords, said outer shell being releasably mounted on an inner assembly;

said inner assembly being resiliently compressible and located within said outer shell, said inner assembly being secured to said manipulating cord and including an extension portion that projects upwardly out of said outer shell, whereby downward pressure on said extension portion causes compression of said inner assembly and release of said outer shell from said inner assembly;

and an upper portion of each shell section being configured to rest and slide on a tapered flange portion of said inner assembly when said outer shell is mounted on said inner assembly, whereby outward movement of said lift cords causes said upper portion of each shell section to slide off said tapered flange portion, thereby releasing said outer shell from said inner assembly.

* * * * *